US005336112A

United States Patent [19]

Michishita et al.

[11] Patent Number: 5,336,112

[45] Date of Patent: Aug. 9, 1994

[54] COAXIAL MICROSTRIP LINE TRANSDUCER

[75] Inventors: Kenji Michishita; Tomoyoshi Ohnishi; Youichi Maruyama; Shigemi Takahashi, all of Nagaokakyo, Japan

[73] Assignee: Murata Manufacturing Co., Ltd., Japan

[21] Appl. No.: 985,189

[22] Filed: Nov. 30, 1992

[30] Foreign Application Priority Data

| | | | |
|---|---|---|---|
| Nov. 30, 1991 | [JP] | Japan | 3-342225 |
| Jan. 17, 1992 | [JP] | Japan | 4-027376 |
| Mar. 6, 1992 | [JP] | Japan | 4-049558 |

[51] Int. Cl.[5] ..... H01R 17/04

[52] U.S. Cl. ..... 439/581; 439/63

[58] Field of Search ..... 439/578, 585, 675, 736, 439/607, 931, 62, 876, 59, 78, 83

[56] References Cited

U.S. PATENT DOCUMENTS

| | | | |
|---|---|---|---|
| 3,564,478 | 2/1971 | Hampton | 439/581 |
| 3,605,075 | 9/1971 | Stofkooper | 439/931 |
| 3,772,632 | 11/1973 | Ratcliff et al. | 439/931 |
| 4,631,505 | 12/1986 | Schiavone | 333/33 |
| 4,645,288 | 2/1987 | Stursa | 339/177 |
| 4,715,832 | 12/1987 | Bach | 439/723 |
| 5,078,621 | 1/1992 | Nishikawa et al. | 439/581 |
| 5,145,382 | 9/1992 | Dickirson | 439/931 |
| 5,158,465 | 10/1992 | Zaderej et al. | 439/931 |

FOREIGN PATENT DOCUMENTS

| | | | |
|---|---|---|---|
| 0419938 | 3/1991 | European Pat. Off. . | |
| 0078171 | 3/1990 | Japan | 439/931 |

*Primary Examiner*—David L. Pirlot

*Attorney, Agent, or Firm*—Ostrolenk, Faber, Gerb & Soffen

[57] ABSTRACT

A coaxial microstrip line transducer, in which an inner conductor has a center conductor portion arranged in a recess portion of a resin case and a terminal portion is integral with the center conductor portion and so formed as to lead to a lower surface of the resin case, and an outer conductor having a first conductor portion arranged along at least a part of an inner peripheral surface of the recess portion and a second conductor portion which is integral with the first conductor portion and extends to the lower surface via an upper surface and a pair of side surfaces opposed to each other of the resin case. The inner and outer conductors are fixed to the resin case.

15 Claims, 10 Drawing Sheets

COAXIAL MICROSTRIP LINE TRANSDUCER

BACKGROUND OF THE INVENTION

1. Field of the Invention

The present invention relates generally to a coaxial microstrip line transducer for use as, for example, a coaxial connector, and more particularly, to a coaxial microstrip line transducer comprising an inner conductor having a center conductor portion arranged in a recess portion opened upward and an outer conductor arranged apart from the center conductor portion.

2. Description of the Prior Art

A coaxial microstrip line transducer shown in FIGS. 12 to 15 has been conventionally known. FIG. 12 is a plan view illustrating a coaxial microstrip line transducer, FIGS. 13 and 14 are respectively a cross sectional view taken along a line V—V shown in FIG. 12 and a cross sectional view taken along a line VI—VI shown in FIG. 12, and FIG. 15 is a bottom view illustrating the coaxial microstrip line transducer.

In this coaxial microstrip line transducer, a cylindrical recess portion 71*a* opened upward is formed in a resin case 71 made of insulating resin. In the recess portion 71*a* are a center conductor portion 72 in a cylindrical shape made of a metal material and a first conductor portion 73 in the shape of a part of a cylindrical curved surface. A lower end of the center conductor portion 72 is integrated into a terminal portion 74 made of a metal material. The terminal portion 74 is so formed as to lead to a lower surface through a side surface of the resin case 71 in order to connect the microstrip line transducer to a connecting land (not shown) on a substrate. That is, the center conductor portion 72 and the terminal portion 74 constitute an inner conductor of the microstrip line transducer.

On the other hand, the first conductor portion 73 is connected to a second conductor portion 75. The second conductor portion 75 is so formed as to lead to the lower surface through the side surface of the resin case 71 in order to connect the microstrip line transducer to the connecting land (not shown) on the substrate. The first conductor portion 73 and the second conductor portion 75 constitute an outer conductor of the microstrip line transducer. In addition, embedded metal parts 76 are formed on the lower surface of the resin case 71 in order to increase stability and bond strength in a case where the microstrip line transducer is mounted on the substrate or the like.

The above described inner conductor and the above described outer conductor are respectively formed by working a metal plate or a metal wire in accordance with a working method such as press working. The above described coaxial microstrip line transducer is constructed by mounting the metal members on the resin case 71 which is a resin molded product.

In the above described microstrip line transducer, the outer conductor comprising the first conductor portion 73 and the second conductor portion 75 is incorporated into the resin case 71 and the second conductor portion 75 is folded along the lower surface of the resin case 71. However, such an assembly operation is very difficult because the resin case 71 is small. That is, the plane dimensions of the resin case 71 are small, for example, approximately 4 mm×4.5 mm, so that the operation which includes passing the outer conductor having a complicated shape from the inside of the recess portion 71*a* to the outer side surface of the resin case 71 and further pulling the same out to the lower surface of the resin case 71 is very difficult. Particularly, there is a strong demand for miniaturization of the microstrip line transducer, as with other electronic components. However, the smaller the dimensions of the microstrip line transducer are, the more difficult the above described assembly operation is. Consequently, the manufacturing processes are complicated, and the manufacturing cost is increased.

Furthermore, in the above described coaxial microstrip line transducer, the terminal portion 74 of the inner conductor, the second conductor portion 75 of the outer conductor, and the embedded metal parts 76 are arranged on the lower surface of the resin case 71, as shown in FIG. 15. The terminal portion 74, the second conductor portion 75, and the embedded metal parts 76 are soldered to a wiring pattern or the connecting land on the substrate, thereby to mount the microstrip line transducer on the substrate. However, the base areas of the terminal portion 74, the second conductor portion 75, and the embedded metal parts 76 are relatively small, so that sufficient soldering strength (mounting strength) cannot be obtained.

It has also been considered to increase the areas of parts, which are located on the lower surface of the resin case 71, of the terminal portion 74, the second conductor portion 75, and the embedded metal parts 76, thereby to increase the soldering strength. However, an attempt to increase the soldering areas causes a heavy load to be applied to the resin case 71 in folding the terminal portion 74 and the second conductor portion 75 along the resin case 71, resulting in the possibility of damaging the resin case 71. Consequently, the soldering areas of the terminal portion 74, the second conductor portion 75, and the embedded metal parts 76 cannot be made so large.

Additionally, as shown in FIG. 13, the inner conductor comprising the center conductor portion 72 and the terminal portion 74 is mounted on the resin case 71 by insert molding. However, the terminal portion 74 is folded along the side surface and the lower surface of the resin case 71 after the insert molding. Consequently, there is a limit on the amount in the thicknesses $T_1$ and $T_2$ (see FIG. 13) of bottom parts of the resin case 71 can be decreased, so that products are prevented from being reduced in height.

SUMMARY OF THE INVENTION

An object of the present invention is to overcome the above described disadvantages of the conventional coaxial microstrip line transducer and to provide a coaxial microstrip line transducer which is easy to manufacture, can be increased in soldering strength (mounting strength) when it is mounted on a substrate or the like, and is easy to miniaturize.

In accordance with a broad aspect of the present invention, there is provided a coaxial microstrip line transducer comprising a resin case having a recess portion opened upward, an inner conductor having a center conductor portion arranged in the recess portion and a terminal portion integrated into the center conductor portion and so formed as to lead to a lower surface of the resin case, and an outer conductor having a first conductor portion arranged along at least a part of an inner peripheral surface of the recess portion and a second conductor portion integrated into the first conductor portion and extended to the lower surface through an upper surface and a pair of side surfaces opposed to each other of the resin case.

In accordance with a particular aspect of the present invention, there is provided a coaxial microstrip line transducer in which a through hole leading to the lower surface of the resin case is formed on a bottom surface of the recess portion of the above described resin case, the center conductor portion in the above described inner conductor is inserted so as to extend into the recess portion from the through hole, and the above described terminal portion is integrated into the center conductor portion on the lower surface of the resin case and so formed as to lead to the pair of side surfaces opposed to each other from the lower surface of the resin case.

Furthermore, in accordance with another broad aspect of the present invention, there is provided a coaxial microstrip line transducer comprising a resin case having a recess portion opened upward, an inner conductor having a center conductor portion arranged in the recess portion and a terminal portion integrated into the center conductor portion and so formed as to lead to a lower surface of the resin case, and an outer conductor having a first conductor portion arranged along at least a part of an inner peripheral surface of the recess portion and a second conductor portion integrated into the first conductor portion and extended to the lower surface through an upper surface and a pair of side surfaces opposed to each other of the resin case, at least one narrow portion having a width relatively smaller than that of the remaining portion being formed in a part of the terminal portion in the above described inner conductor.

In the coaxial microstrip line transducer according to the present invention, the center conductor portion is arranged in the recess portion of the resin case, and the outer conductor is so arranged as to lead to the lower surface through the upper surface and the pair of side surfaces opposed to each other of the resin case from the inside of the recess portion, as described above. Accordingly, the outer conductor can be easily incorporated into the resin case by fitting the outer conductor to the resin case. Consequently, it is possible to simplify the manufacturing processes and reduce the manufacturing cost of the coaxial microstrip line transducer.

Furthermore, the outer conductor has the above described shape. Accordingly, a capacitance component created between the center conductor portion and the first conductor portion in the outer conductor can be canceled by an inductance constituent created by the shape of the outer conductor, thereby to make it possible to restrain impedance mismatching.

Additionally, the above described structure in which the center conductor portion is inserted into the recess portion through the through hole from the lower surface of the resin case makes it easy to incorporate the center conductor portion into the resin case. Accordingly, it is possible to further simplify the manufacturing processes and reduce the manufacturing cost of the microstrip line transducer.

Moreover, in accordance with the above described other wide aspect of the present invention, the narrow portion is provided in the terminal portion in the inner conductor, so that a capacitance constituent created in the microstrip line transducer is compensated for by an inductance constituent created in the narrow portion. Consequently, it is possible not only to simplify the manufacturing processes and reduce the manufacturing cost of the coaxial microstrip line transducer but also to prevent the characteristic impedance from being lowered, thereby allowing impedance matching to be enhanced. Accordingly, there can be provided a coaxial microstrip line transducer low in reflection and low in voltage standing-wave ratio.

The foregoing and other objects, features, aspects and advantages of the present invention will become more apparent from the following detailed description of the present invention when taken in conjunction with the

DESCRIPTION OF THE PREFERRED EMBODIMENTS

Figure 1:
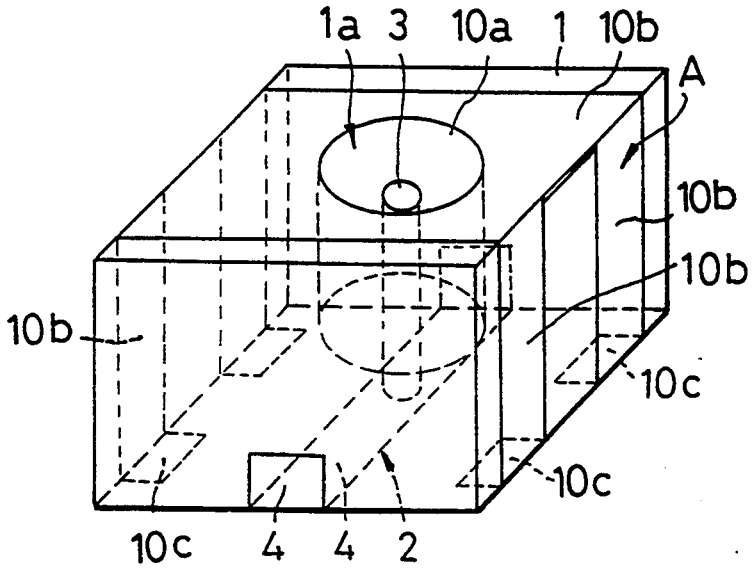
FIG. 1 is a perspective view illustrating a coaxial microstrip line transducer according to a first embodiment of the present invention.
Figure 2:
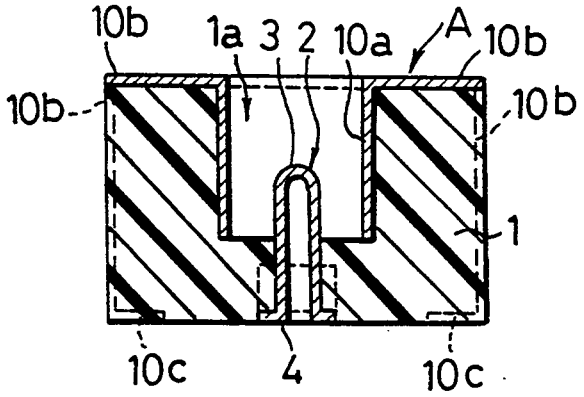
FIG. 2 is a cross sectional view illustrating a coaxial microstrip line transducer according to the first embodiment.

FIG. 1 is a perspective view illustrating a coaxial microstrip line transducer according to a first embodiment of the present invention, and FIG. 2 is a cross sectional view thereof. As shown in FIGS. 1 and 2, in the coaxial microstrip line transducer according to the present invention, a recess portion 1*a* opened upward is formed in a resin case 1 made of insulating resin. A center conductor portion 3 of an inner conductor 2 is inserted in the recess portion 1*a*. The inner conductor 2 has the center conductor portion 3 composed of a cylindrical conductor and a terminal portion 4 integral with a lower end of the center conductor portion 3. The terminal portion 4 is so formed as to lead to a pair of side surfaces opposed to each other from a lower surface of the resin case 1.

Furthermore, an outer conductor A is constructed by integrally forming a first conductor portion 10*a* in a cylindrical shape and a second conductor portion comprising a bridge portion 10*b* and a terminal portion 10*c* and is mounted on the resin case 1, as shown in FIG. 2. The first conductor portion 10*a* is arranged along the whole inner peripheral surface of the recess portion 1*a* of the resin case 1. On the other hand, the second conductor portion is constructed by integrating (1) the bridge portion 10*b* leading to the lower surface via the pair of side surfaces opposed to each other from an upper surface of the resin case 1, and (2) the terminal portion 10*c* formed along the lower surface of the resin case 1.

The outer conductor A is formed in a shape as shown and is fixed to the resin case 1 by previously fabricating a member wherein the bridge portion 10*b* and the terminal portion 10*c* are not folded, by a method, for example, such as press working, mounting the member on the resin case 1, and folding the member along the outer surface of the resin case 1 by pressing using a mold (not shown).

Figure 3:
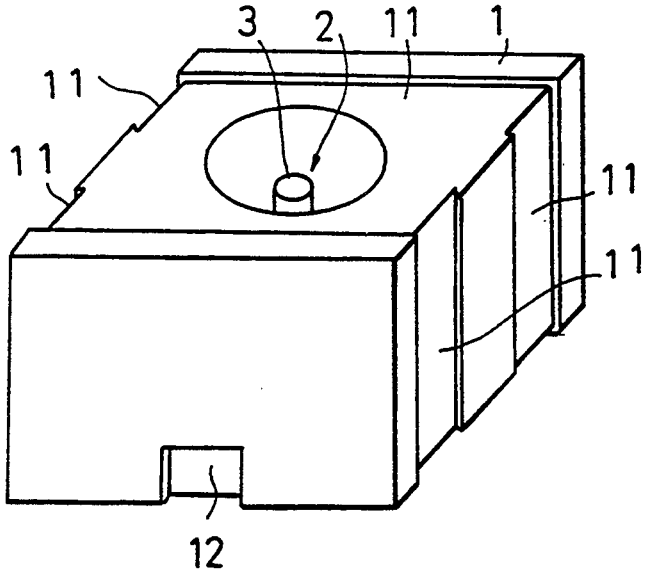
FIG. 3 is a perspective view illustrating a resin case for constituting the coaxial microstrip line transducer according to the first embodiment.

A groove 11 having a shape corresponding to the shape of the above described outer conductor A and a groove 12 having a shape corresponding to the shape of the terminal portion 4 in the inner conductor 2 are formed on the outer surface of the resin case 1, as shown in FIG. 3. The outer conductor A is fitted in the groove 11, and the terminal portion 4 is fitted in the groove 12. The depths of the grooves 11 and 12 are respectively so selected that the outer conductor A and the terminal portion 4 do not project outward from the outer surface of the resin case 1 when the outer conductor A and the terminal portion 4 are fitted on the resin case 1. Consequently, in a state where the outer conductor A and the terminal portion 4 are fixed to the resin case 1, the external dimensions of the microstrip line transducer are not increased. That is, since the above described grooves 11 and 12 are provided, the microstrip line transducer is not prevented from being miniaturized and reduced in height.

In the coaxial microstrip line transducer according to the present embodiment, the outer conductor A is composed of a member so constructed as to lead to the lower surface via the upper surface and the pair of side surfaces opposed to each other, from the inner peripheral surface of the recess portion 1*a* of the resin case 1, and is mounted on the resin case 1 by pressing using a mold. Accordingly, it is easy to assemble the coaxial microstrip line transducer, thereby to simplify the manufacturing processes thereof. Consequently, it is possible to effectively reduce the manufacturing cost of the coaxial microstrip line transducer.

Furthermore, in the coaxial microstrip line transducer according to the present embodiment, the outer conductor A has the above described shape, and an inductance constituent created by the shape cancels a capacitance constituent created between the outer conductor A and the center conductor portion 3 of the inner conductor 2. In the microstrip line transducer according to the present embodiment, therefore, impedance mismatching is effectively restrained, reflection is reduced, and the electrical properties are enhanced as compared with those of the conventional coaxial microstrip line transducer.

Additionally, the above described coaxial microstrip line transducer is so constructed that the outer conductor A is fitted in the groove 11 formed in the resin case 1. Accordingly, the external dimensions and the height of the whole microstrip line transducer are not increased, although the outer conductor A is arranged along the outer side surface of the resin case 1. In addition, the terminal portion 4 of the inner conductor 2 is contained in the groove 12. Accordingly, the terminal portion 4 also does not project outward from the outer surface of the resin case 1. Therefore, the external dimensions and the height of the coaxial microstrip line transducer are not increased, thereby to also enable miniaturization of the microstrip line transducer.

In the present embodiment, an example is illustrated in which the bridge portion 10*b* and the terminal portion 10*c* constituting the second conductor portion in the outer conductor A are branched into two parts. The main purpose of this shape is to correspond to a wiring pattern such as a connecting land on a substrate. Consequently, the shape of the outer conductor A, including a part, which is located on the upper surface of the resin case 1, of the bridge portion 10*b*, may be changed to another different shape depending on the use conditions.

Figure 4:
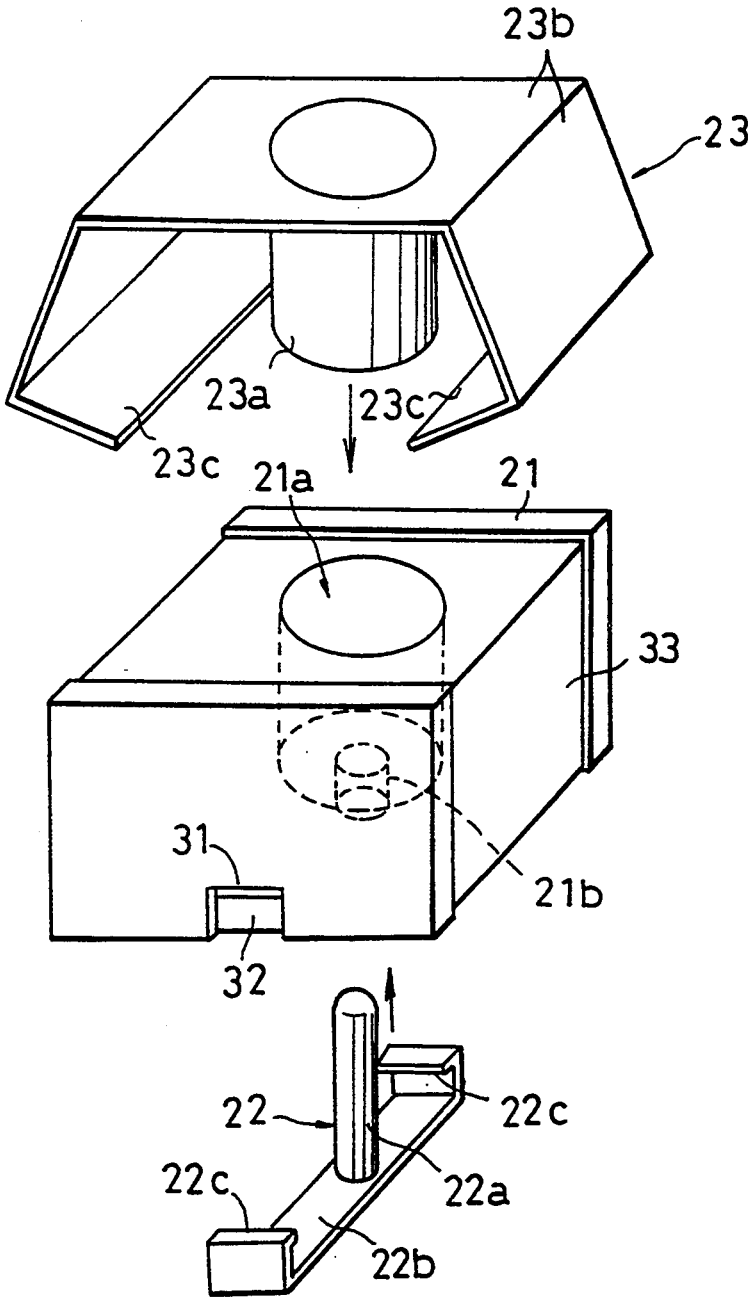
FIG. 4 is an exploded perspective view for explaining a coaxial microstrip line transducer according to a second embodiment.
Figure 5:
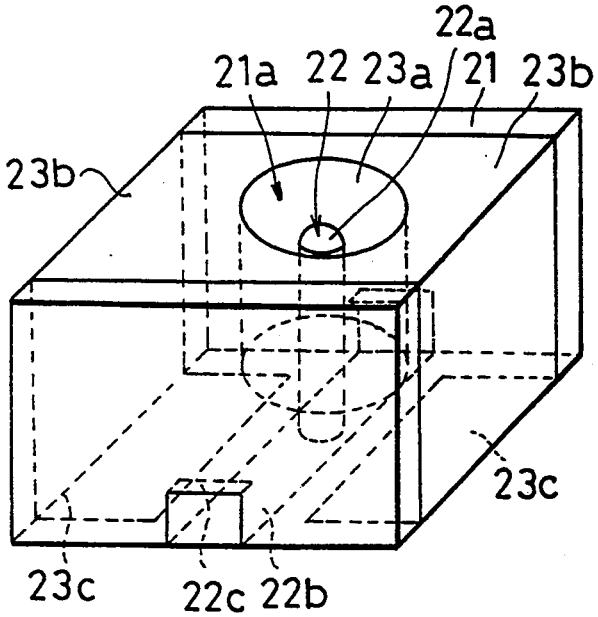
FIG. 5 is a perspective view illustrating the coaxial microstrip line transducer according to the second embodiment.
Figure 6:
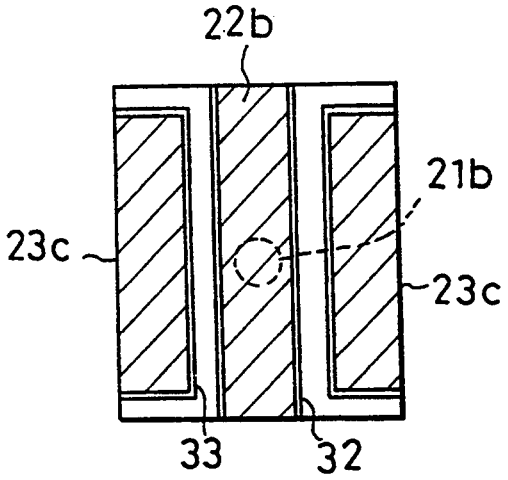
FIG. 6 is a bottom view illustrating the coaxial microstrip line transducer according to the second embodiment.

FIG. 4 is an exploded perspective view illustrating a coaxial microstrip line transducer according to a second embodiment of the present invention, FIGS. 5 and 6 are respectively a perspective view and a bottom view illustrating the coaxial microstrip line transducer according to the second embodiment.

As shown in FIGS. 4 and 5, in the coaxial microstrip line transducer according to the second embodiment, a recess portion 21*a* opened upward is formed in a resin case 21, as in the first embodiment. However, a through hole 21*b* leading to a lower surface of the resin case 21 is formed in a bottom surface of the recess portion 21*a*. The through hole 21*b* is provided so as to insert a center conductor portion 22*a* in an inner conductor 22 shown in the lower part of FIG. 4 into the recess portion 21*a*. The inner conductor 22 comprises the center conductor portion 22*a* in a cylindrical shape, a terminal portion 22*b* integral with a lower end of the center conductor portion 22*a*, extended in the horizontal direction and folded upward on the side of its ends, and ends 22*c* folded toward the center conductor portion 22*a* in ends of parts folded upward of the terminal portion 22*b*.

On the other hand, a groove 32 in which the terminal portion 22*b* in the above described inner conductor 22 is fitted is formed on the lower surface and a pair of side surfaces opposed to each other of the resin case 21, and an engaging hole 31 is formed at an upper end of the groove 32 on each of the pair of side surfaces opposed to each other of the resin case 21. The above described ends 22*c* are fitted in the engaging holes 31.

The above described inner conductor 22 is fixed to the resin case 21 by inserting the center conductor portion 22*a* into the through hole 21*b* from below the resin case 21 and fitting the ends 22*c* provided in the ends of the above described terminal portion 22*b* in the engaging hole 31.

On the other hand, an outer conductor 23 is mounted on the resin case 21 from above the resin case 21. The outer conductor 23 comprises a cylindrical portion 23*a* along an inner peripheral surface of the recess portion 21*a*, a bridge portion 23*b* formed integrally with an upper end of the cylindrical portion 23*a* and leading to the upper surface and the pair of side surfaces opposed to each other of the resin case 21, and terminal portions 23*c* located on the lower surface of the resin case 21. In addition, the widths of the bridge portion 23*b* and the terminal portions 23*c* are made approximately equal to or slightly smaller than the width of the resin case 21. That is, the bridge portion 23*b* and the terminal portions 23*c* are so formed as to have a width relatively larger, as compared with that of the terminal portion in the outer conductor A in the first embodiment.

On the other hand, the resin case 21 is provided with a groove 33 in which the bridge portion 23*b* and the terminal portions 23*c* in the above described outer conductor 23 can be fitted. The outer conductor 23 is mounted on the resin case 21 by previously preparing a member comprising the bridge portion 23*b*, the terminal portions 23*c* and the like which are bent to some extent by a method, for example, such as press working, and fitting and fixing the member to the resin case 21. Consequently, the outer conductor 23 can be reliably engaged with the resin case 21 without applying high stress to the resin case 21.

As can be seen from FIGS. 5 and 6, the terminal portions 23*c* in the above described outer conductor 23 lead to positions close to the terminal portion 22*b* in the inner conductor 22 on the lower surface of the resin case 21, so that the area of the terminal portions 23*c* is very large.

Alternatively, the outer conductor 23 may be formed in a predetermined shape and at the same time, fixed to the resin case 21, by fabricating an outer conductor member wherein the terminal portions 23*c* are not folded, engaging the member with the resin case 21 and then, folding the member along the outer surface of the resin case 21 by pressing using a mold, depending on the shape, the strength and the like of the resin case 21.

Also in the coaxial microstrip line transducer according to the second embodiment, it is possible to easily mount the outer conductor 23 on the resin case 21 by fitting the outer conductor 23 in the resin case 21, as in the first embodiment. Further, in the second embodiment, the inner conductor 22 having a structure in which the center conductor portion 22*a* and the terminal portion 22*b* are integrally formed in a predetermined shape is mounted on the resin case 21 by fitting the inner conductor 22 in the resin case 21. Consequently, it is possible to further simplify the manufacturing processes and reduce the manufacturing cost, as compared with those in the first embodiment.

Furthermore, in the coaxial microstrip line transducer according to the second embodiment, the terminal portion 22*b* in the inner conductor 22 leads to the pair of side surfaces opposed to each other from the lower surface of the resin case 22, and a portion extending from one side surface of the pair of side surfaces opposed to each other of the resin case 21 to the other side surface thereof is used as a soldering portion. Further, a wide portion having a large area, which leads to the lower surface of the resin case 21, of the outer conductor 23 is used as a soldering portion. As also apparent from FIG. 6, therefore, the soldering area is very large as a whole, thereby to make it possible to increase the soldering strength, that is, the mounting strength on the substrate or the like.

Furthermore, also in the coaxial microstrip line transducer according to the second embodiment, the outer conductor 23 is fitted in the above described groove 33. Accordingly, in a state where the outer conductor 23 is mounted, the external dimensions and the height of the coaxial microstrip line transducer are not increased. Similarly, the terminal portion 22*b* in the inner conductor 22 is also fitted in the groove 32 so that it is not projected outward from the outer surface of the resin case 21. Consequently, the coaxial microstrip line transducer is not prevented from being miniaturized, similarly to the coaxial microstrip line transducer according to the first embodiment.

According to the above described first and second embodiments, in respectively fixing the outer conductors A and 23 to the resin cases 1 and 21, the outer conductors A and 23 are hot-pressed against the resin cases 1 and 21 or bonded thereto by applying heat. Accordingly, the mounting strength of the outer conductors A and 23 can be increased, thereby to make it possible to further increase the reliability.

Additionally, although in the first and second embodiments, the cylindrical portions 10*a* and 23*a* in the outer conductors A and 23 are respectively formed in cylindrical shapes corresponding to the inner peripheral surfaces of the recess portions 1*a* and 21*a* of the resin cases 1 and 21, they need not be necessarily formed in shapes along the whole inner peripheral surfaces of the recess portions 1*a* and 21*a*. That is, the above described cylindrical portions 10*a* and 23*a* may be replaced with members in the shape of a part of a cylindrical curved surface along only parts of the recess portions 1*a* and 21*a*.

Furthermore, in the microstrip line transducers according to the first and second embodiments, the shapes of the resin cases 1 and 21, the center conductor portions 3 and 22*a*, the terminal portions 4 and 22*b* pulled out from the center conductor portions 3 and 22*a*, and the like are not limited to those in the embodiments as shown. For example, they may be deformed into various shapes within the range in which the objects of the present invention are attained.

Moreover, embedded metal parts may be formed on the lower surfaces of the resin cases 1 and 21 so as to ensure stability and strength in a case where the microstrip line transducers are mounted on the substrates or the like, which are not provided for the microstrip line transducers according to the first and second embodiments.

Figure 7:
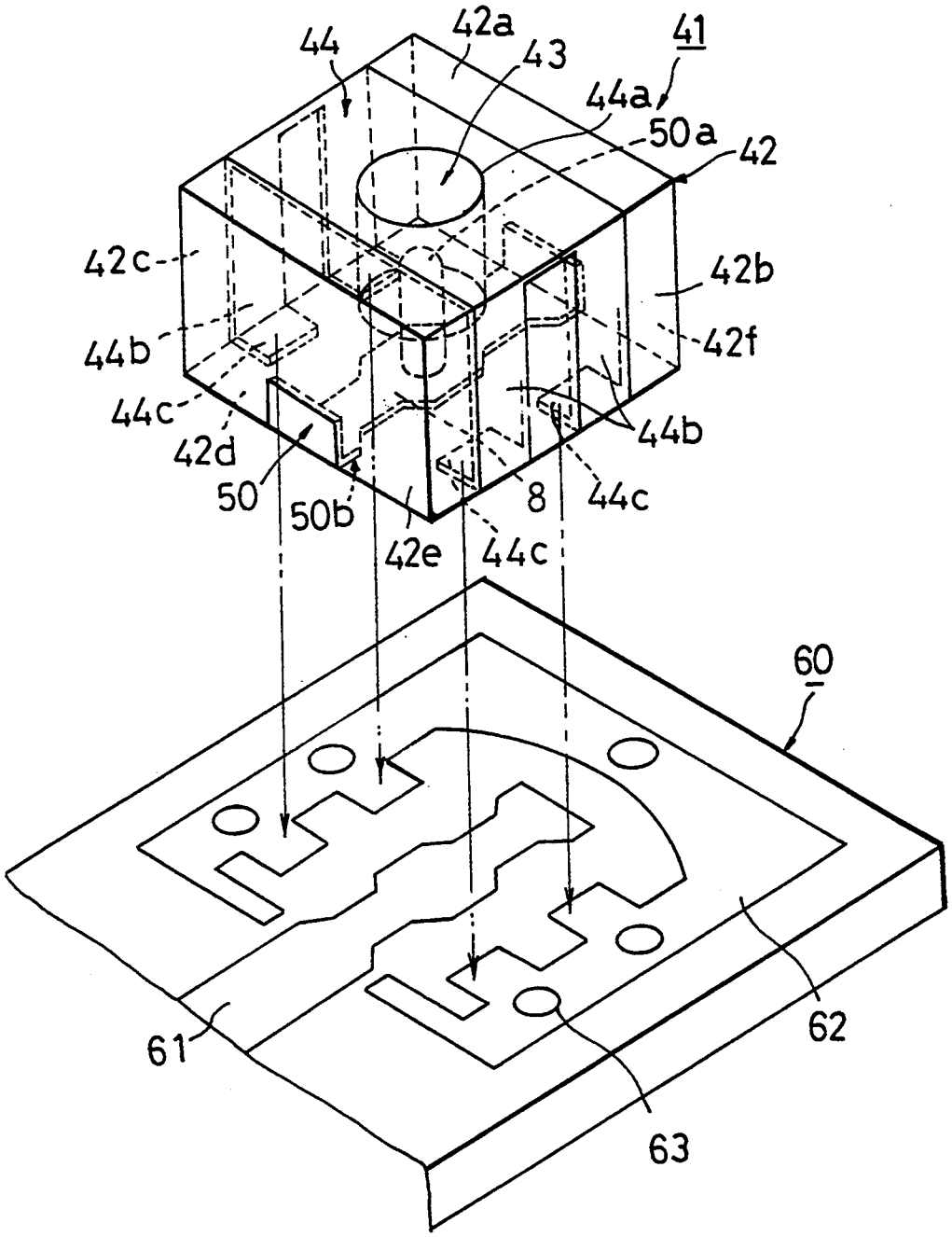
FIG. 7 is a perspective view for explaining a coaxial microstrip line transducer according to a third embodiment.
Figure 8:
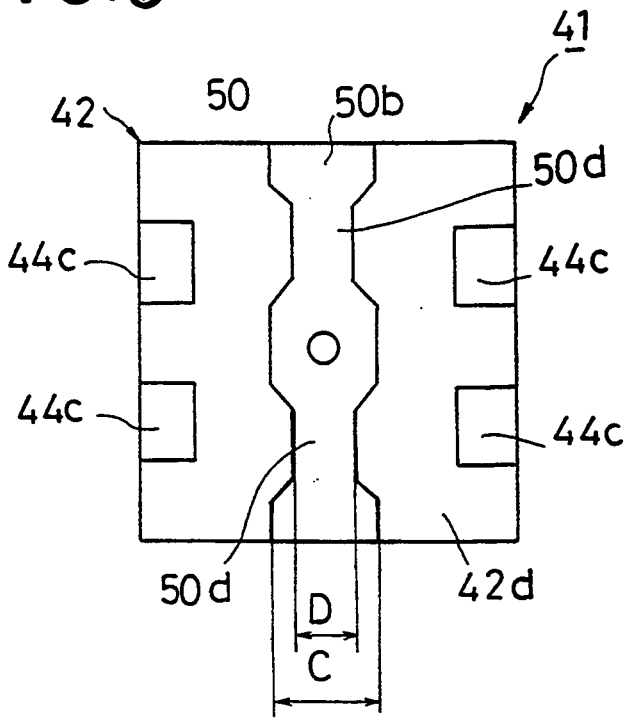
FIG. 8 is a bottom view illustrating the coaxial microstrip line transducer according to the third embodiment.

FIGS. 7 and 8 are respectively a perspective view for explaining a coaxial microstrip line transducer according to a third embodiment of the present invention and a plane view illustrating the coaxial microstrip line transducer.

The basic construction of the coaxial microstrip line transducer 41 in the third embodiment is the same as that in the first embodiment. Consequently, the description of common portions are omitted by incorporating the description in the first embodiment.

The coaxial microstrip line transducer 41 according to the present embodiment has a resin case 42 in a roughly cubic shape. A recess portion 43 opened toward an upper surface 42*a* is formed in the resin case 42. An outer conductor 44 and an inner conductor 50 are mounted on the resin case 42, as in the first embodiment.

More specifically, the outer conductor 44 mounted from above the upper surface 42*a* of the resin case 42 comprises a cylindrical portion 44*a* formed along an inner peripheral surface of the recess portion 43, a relay portion 44*b* integrated into an upper end of the cylindrical portion 44a and so extended as to lead to a pair of side surfaces 42b and 42c opposed to each other from the upper surface 42a of the resin case 41, and terminal portions 44c extended to a lower surface 42d of the resin case 41. The above described relay portion 44b is branched on the side surfaces of the resin case 41, and the terminal portions 44c leading to the lower surface of the resin case 41 are respectively formed in ends of parts obtained by the branch.

The above described outer conductor 44 can be mounted on the resin case 41, in the same manner as the first and second embodiments. Further, also in the present embodiment, a groove is formed on the outer surface of the resin case 41 in conformity with the shape of the outer conductor 44, and the relay portion 44b and the terminal portions 44c in the outer conductor 44 are fitted in the groove, so that the outer conductor 44 is not projected outward from the surface of the resin case 41 in a state where the outer conductor 44 is mounted.

On the other hand, the inner conductor 50 is mounted on the lower surface of the resin case 41. The inner conductor 50 comprises a center conductor portion 50a inserted in the recess portion 43 and a terminal portion 50b integrated into a lower end of the center conductor portion 50a. Both ends of the terminal portion 50b are respectively folded upward so as to lead to a pair of side surfaces 42e and 42f opposed to each other of the resin case 41. The inner conductor 50 is also fitted in a groove formed on the outer surface of the resin case 41 so that its outer surface is not projected outward from the outer surface of the resin case 41 when it is mounted on the resin case 41.

Also in the coaxial microstrip line transducer 41 according to the present embodiment, therefore, the external dimensions and the height thereof are not increased in a state where the outer conductor 44 and the inner conductor 50 are mounted, thereby to make it possible to smoothly cope with the miniaturization of the coaxial microstrip line transducer.

Furthermore, the above described outer conductor 44 and the above described inner conductor 50 can be mounted in the same manner as the above described embodiments, thereby to make it possible to simplify the manufacturing processes and reduce the manufacturing cost of the coaxial microstrip line transducer. Also, it is possible to increase the mounting strength on the substrate as in the first and second embodiments.

In FIG. 7, reference numeral 60 denotes a microstrip line to which the coaxial microstrip line transducer 41 according to the present embodiment is connected. A hot line 61 and a ground line 62 are formed in the microstrip line 60. In addition, reference numeral 63 denotes a through hole. The through hole 63 is connected to a ground line (not shown) on the reverse surface by a conductor (not shown) formed in an inner peripheral surface of the through hole.

Description is now made of the characteristic construction of the microstrip line transducer 41 according to the third embodiment. As shown in a bottom view of FIG. 8, the inner conductor 50 has narrow portions 50d having a relatively small width in the terminal portion 50b. That is, the inner conductor 50 is so constructed that the narrow portions 50d have a width D as shown, while another portion without the narrow portions 50d in the terminal portion 50b has a width C as shown. In the present embodiment, the narrow portions 50d are provided, so that an inductance constituent is created in the narrow portions 50d, and stray capacitance F produced inside of the coaxial microstrip line transducer 41 is compensated for by the inductance constituent, to prevent the variation in the characteristic impedance. This will be described in more detail.

Also in the coaxial microstrip line transducer 41 according to the present embodiment, if a high-frequency signal is incident thereon, the stray capacitance F is forced to be produced between the outer conductor 44 and the inner conductor 50. This stray capacitance F is inserted in parallel in a circuit, as shown in an equivalent circuit diagram of FIG. 9. Consequently, the inherent capacitance is increased. In addition, the characteristic impedance in the microstrip line transducer 41 is decreased.

More specifically, the characteristic impedance $Z_0$ generally has the relationship of $Z_0=(L/C)$. In the above described equation, $Z_0$ denotes the characteristic impedance, L denotes an inductance value per unit length, and C denotes a capacitance value per unit length. In the equation, if the capacitance value C is increased due to the production of the stray capacitance F, the characteristic impedance $Z_0$ is decreased by the amount of increase. That is, the characteristic impedance at a point where the coaxial microstrip line transducer 41 is inserted is smaller than the characteristic impedance in a transmission network (generally, 50 Ω).

In the present embodiment, however, the terminal portion 50b in the above described inner conductor 50 is provided with the narrow portions 50d. Consequently, if the high-frequency signal is incident, inductance $L_1$ arises in the narrow portions 50d. This inductance $L_1$ is connected in parallel in a transmission network, so that the inductance value L in the above described equation is increased. The amount of increase in the inductance value cancels the amount of increase in the capacitance value due to the stray capacitance F. Consequently, the characteristic impedance $Z_0$ is not decreased. That is, the stray capacitance F is compensated for by the inductance $L_1$ arising in the narrow portions 50d, so that the characteristic impedance $Z_0$ in the microstrip line transducer 41 is prevented from being decreased, thereby maintaining impedance matching with the transmission network.

Meanwhile, the stray capacitance F produced in the microstrip line transducer 41 subtly varies depending on the shape of the resin case 42, the dielectric constant, and the shapes of the outer conductor 44 and the inner conductor 50. Consequently, the shape and the number of narrow portions 50d for compensating for the stray capacitance F may be changed depending on the above described various conditions. That is, although in the above described embodiment, a total of two narrow portions 50d are formed, the number of narrow portions 50d may be increased or decreased depending on the value of the stray capacitance F produced. In addition, the whole outer conductor 50 may be a narrow portion 50d by making the whole width of the inner conductor 50 smaller than a predetermined width.

Figure 9:
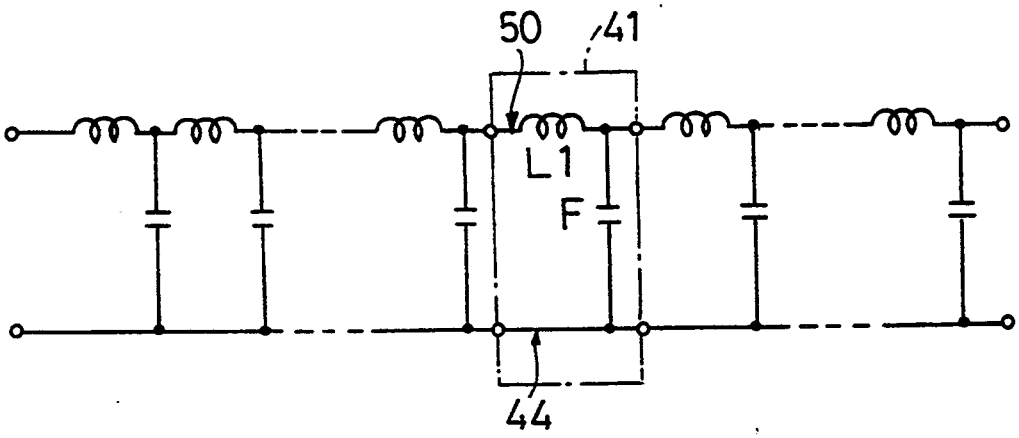
FIG. 9 is a diagram showing an equivalent circuit of a transmission network to which the coaxial microstrip line transducer according to the third embodiment is connected.
Figure 10:
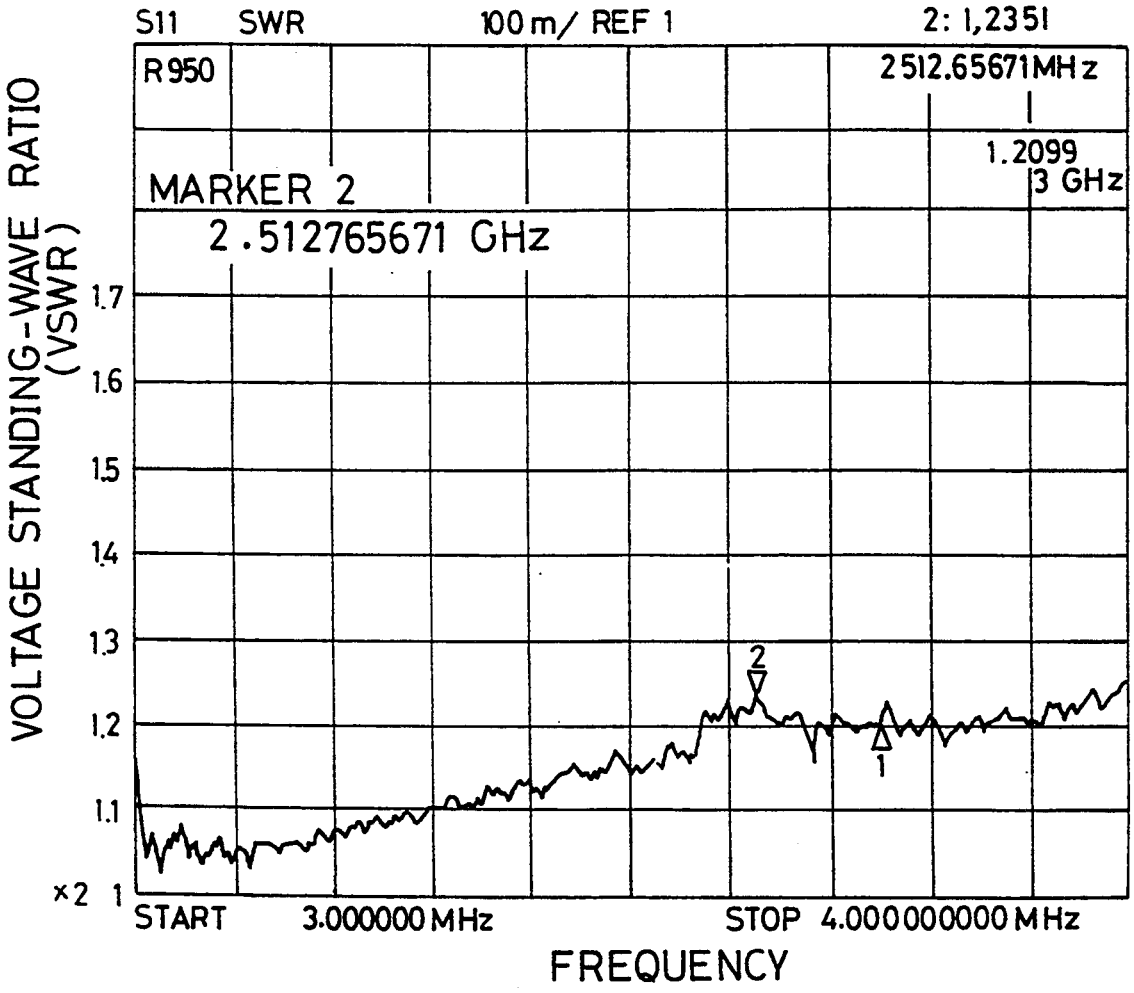
FIG. 10 is a diagram showing the voltage standing-wave ratio (VSWR) of the coaxial microstrip line transducer according to the third embodiment.
Figure 11:
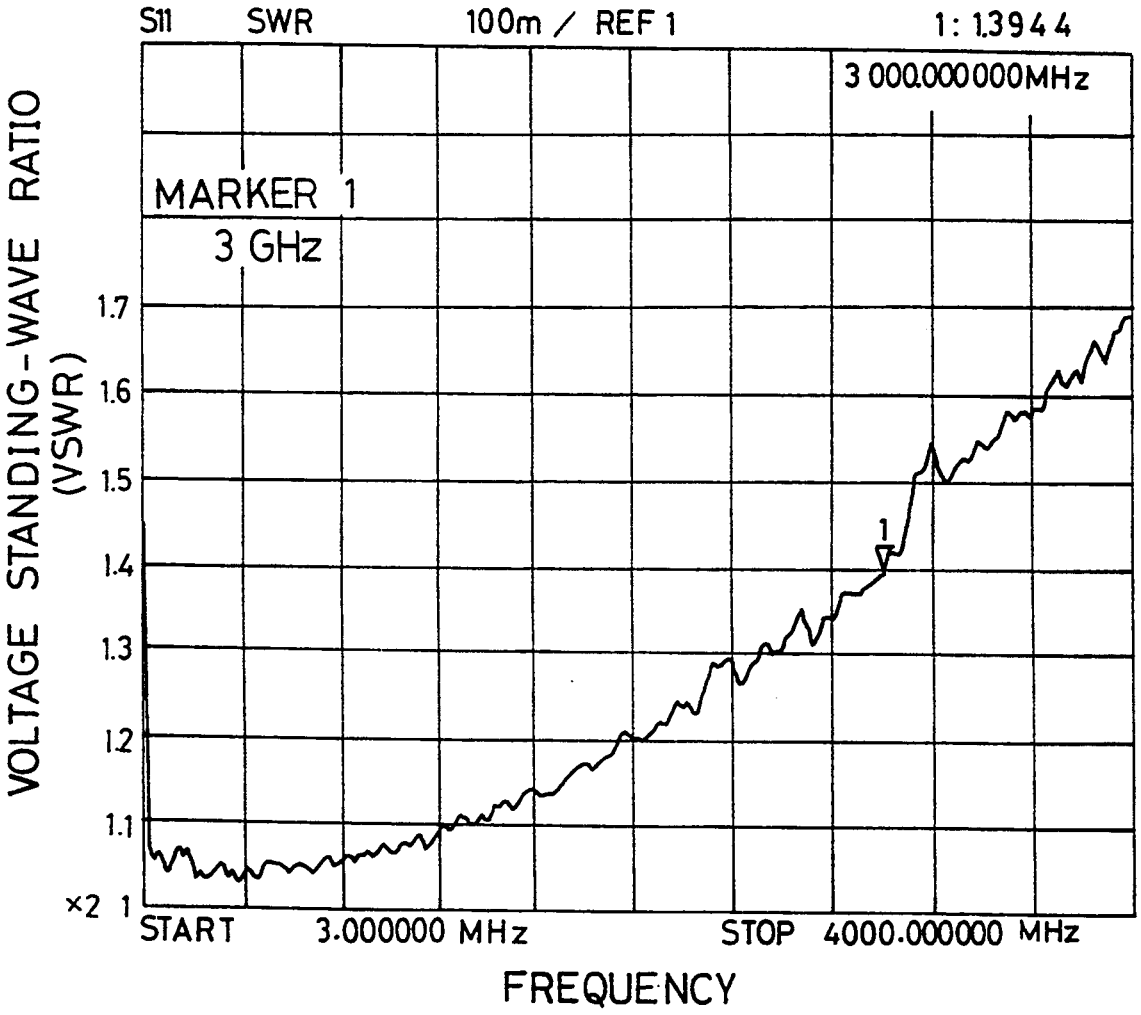
FIG.11 PRIOR ART
FIG. 11 is a diagram showing the voltage standing-wave ratio (VSWR) of a coaxial microstrip line transducer prepared for comparison.
Figure 12:
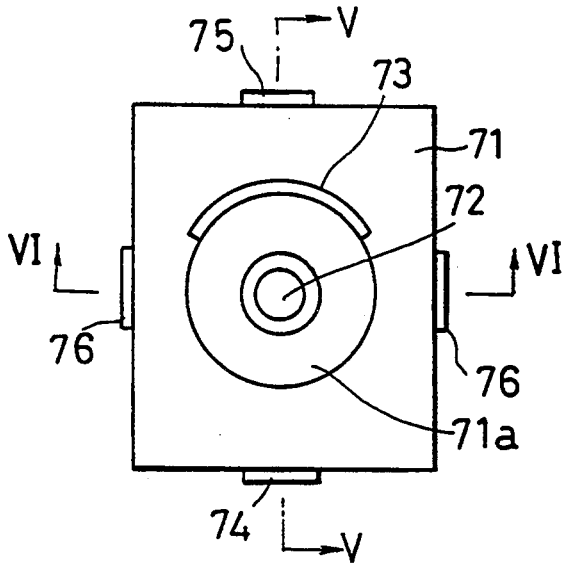
FIG.12 PRIOR ART
FIG. 12 is a plane view illustrating one example of the conventional coaxial microstrip line transducer.
Figure 13:
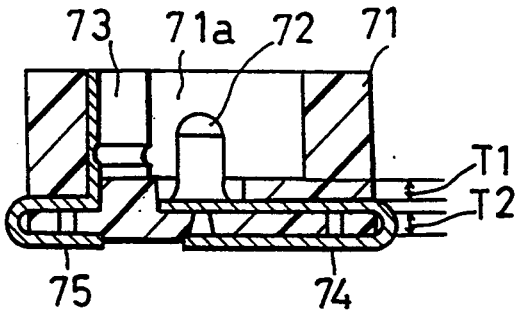
FIG13 PRIOR ART
FIG. 13 is a cross sectional view taken along a line V—V shown in FIG. 12.
Figure 14:
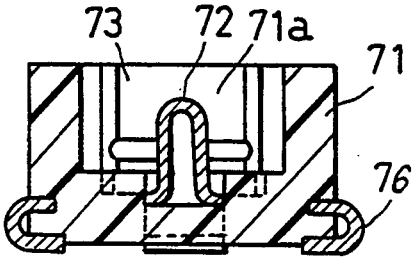
FIG.14 PRIOR ART
FIG. 14 is a cross sectional view taken along a line VI—VI shown in FIG. 12.
Figure 15:
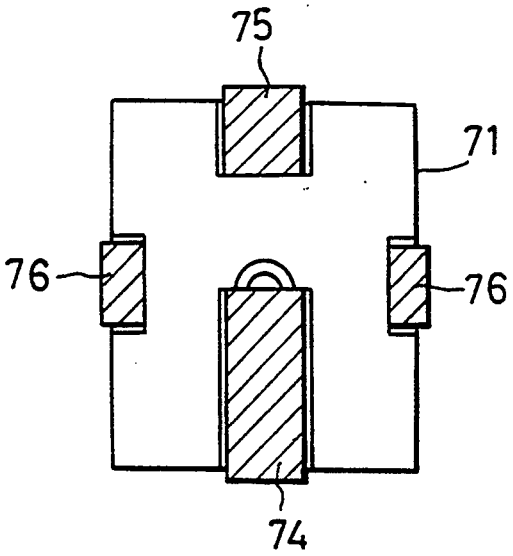
FIG15 PRIOR ART
FIG. 15 is a bottom view illustrating the conventional coaxial microstrip line transducer.

FIG. 9 shows the voltage standing-wave ratio (VSWR) of the coaxial microstrip line transducer 41 according to the present embodiment constructed in the above described manner, and FIG. 10 shows the voltage standing-wave ratio (VSWR) of a coaxial microstrip line transducer having a corresponding structure in which no narrow portion is provided. As can be seen from the comparison between FIGS. 9 and 10, in the coaxial microstrip line transducer according to the present embodiment, the voltage standing-wave ratio (VSWR) is decreased, so that the electrical properties are enhanced.

Although in the present embodiment, the present invention is applied to the coaxial microstrip line transducer 41, the present invention is not limited to the same. For example, the present invention is also applicable to a coaxial coplanar transducer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A coaxial microstrip line transducer comprising:

a resin case having a recess portion opened upward;

an inner conductor having a center conductor portion arranged in said recess portion and a terminal portion integral with the center conductor portion and formed so as to lead to a lower surface of said resin case; and an outer conductor having a first conductor portion arranged along at least a part of an inner peripheral surface of said recess portion and a second conductor portion integral with said first conductor portion and extending to the lower surface through an upper surface and a pair of side surfaces opposed to each other of said resin case;

a through hole leading to the lower surface of the resin case being formed in a bottom surface of the recess portion of said resin case;

the center conductor portion of said inner conductor being inserted so as to extend into the recess portion from said through hole; and said terminal portion being integral with the center conductor portion at the lower surface of said resin case and formed so as to lead to the pair of side surfaces opposed to each other from the lower surface of the resin case;

wherein an engaging hole is formed on each of the respective side surfaces of said resin case, and ends of parts, which lead to the side surfaces of the resin case, of the terminal portion of said inner conductor are engaged with said engaging holes.

2. The coaxial microstrip line transducer according to claim 1, wherein a groove in which said second conductor portion is fitted is formed on the upper surface, the side surfaces and the lower surface of said resin case, the depth of said groove being so selected that an outer surface of said second conductor portion is not projected outward from the outer surface of said resin case in a case where the second conductor portion is fitted.

3. The coaxial microstrip line transducer according to claim 1, wherein at least one narrow portion having a width relatively smaller than that of another portion is formed in the terminal portion in said inner conductor.

4. The coaxial microstrip line transducer according to claim 1, wherein the first conductor portion in said outer conductor is a cylindrical conductor portion arranged along the whole inner peripheral surface of the recess portion.

5. The coaxial microstrip line transducer according to claim 1, wherein said cylindrical conductor portion is a cylindrical conductor.

6. The coaxial microstrip line transducer according to claim 1, wherein the width of at least a part, which is extended to the lower surface of the resin case, of the second conductor portion in said outer conductor is larger than the width of said recess portion.

7. The coaxial microstrip line transducer according to claim 1, wherein a groove in which said second conductor portion is fitted is formed on the upper surface, the side surfaces and the lower surface of said resin case, the depth of said groove being so selected that an outer surface of said second conductor portion is not projected outward from the outer surface of said resin case in a case where the second conductor portion is fitted.

8. The coaxial microstrip line transducer according to claim 1, wherein at least one narrow portion having a width relatively smaller than that of the another portion is formed in the terminal portion in said inner conductor.

9. The coaxial microstrip line transducer according to claim 1, wherein the first conductor portion in said outer conductor is a cylindrical conductor portion arranged along the whole inner peripheral surface of the recess portion.

10. The coaxial microstrip line transducer according to claim 9, wherein said cylindrical conductor portion is a cylindrical conductor.

11. A coaxial microstrip line transducer comprising:

a resin case having a recess portion opened upward;

an inner conductor having a center conductor portion arranged in said recess portion and a terminal portion integral with the center conductor portion and formed so as to lead to a lower surface of said resin case; and an outer conductor having a first conductor portion arranged along at least a part of an inner peripheral surface of said recess portion and a second conductor portion integral with said first conductor portion and extending to the lower surface through an upper surface and a pair of side surfaces opposed to each other of said resin case, at least one narrow portion having a width relatively smaller than that of another portion being formed in a part of the terminal portion in said inner conductor; and wherein:

a through hole leading to the lower surface of the resin case is formed in a bottom surface of the recess portion of said resin case, the center conductor portion of said inner conductor is inserted so as to extend into the recess portion from said through hole, and said terminal portion is integral with the center conductor portion at the lower surface of said resin case and is formed so as to lead to the pair of side surfaces opposed to each other from the lower surface of the resin case;

wherein an engaging hole is formed on each of the side surfaces of said resin case, and ends of parts, which lead to the side surfaces of the resin case, of the terminal portion in said inner conductor are engaged with said engaging holes.

12. The coaxial microstrip line transducer according to claim 11, wherein a groove in which said second conductor portion is fitted is formed on the upper surface, the side surfaces and the lower surface of said resin case, the depth of said groove being so selected that an outer surface of said second conductor portion is not projected outward from the outer surface of said resin case in a state where the second conductor portion is fitted.

13. The coaxial microstrip line transducer according to claim 11, wherein the first conductor portion in said outer conductor is a cylindrical conductor portion arranged along the whole inner peripheral surface of the recess portion.

14. The coaxial microstrip line transducer according to claim 13, wherein said cylindrical conductor portion is a cylindrical conductor.

15. A coaxial microstrip line transducer comprising:

a resin case having a recess portion opened upward;

an inner conductor having a center conductor portion arranged in said recess portion and a terminal portion integral with the center conductor portion and formed so as to lead to a lower surface of said resin case; and an outer conductor having a first conductor portion arranged along at least a part of an inner peripheral surface of said recess portion and a second conductor portion integral with said first conductor portion and extending to the lower surface through an upper surface and a pair of side surfaces opposed to each other of said resin case;

wherein an engaging hole is formed on each of the side surfaces of said resin case, and ends of parts, which lead to the side surfaces of the resin case, of the terminal portion of said inner conductor are engaged with said engaging holes.

* * * * *

UNITED STATES PATENT AND TRADEMARK OFFICE

CERTIFICATE OF CORRECTION

PATENT NO. : 5,336,112

DATED : August 9, 1994

INVENTOR(S) : Michishita, et. al.

It is certified that error appears in the above-indentified patent and that said Letters Patent is hereby corrected as shown below:

Title page, item [75], inventor: change

"Inventors: Kenji Michishita; Tomoyoshi Ohnishi; Youichi Maruyama; Shigemi Takahashi, all of Nagaokakyo, Japan"

to

--Inventors: Kenshi Michishita; Tomoyoshi Ohnishi; Yuichi Maruyama; Shigeki Takahashi, all of Kyoto-fu, Japan--

Signed and Sealed this

Second Day of January, 1996

Bruce Lehman

*Attest:*

BRUCE LEHMAN

*Attesting Officer*

*Commissioner of Patents and Trademarks*